US006010305A

United States Patent [19]

Hauser

[11] Patent Number: 6,010,305

[45] Date of Patent: Jan. 4, 2000

[54] AXIAL-FLOW FAN FOR THE RADIATOR OF AN INTERNAL COMBUSTION ENGINE

[75] Inventor: Kurt Hauser, Suessen, Germany

[73] Assignee: Behr GmbH & Co., Stuttgart, Germany

[21] Appl. No.: 09/041,739

[22] Filed: Mar. 13, 1998

[30] Foreign Application Priority Data

Mar. 14, 1997 [DE] Germany ..... 197 10 608

[51] Int. Cl.[7] ..... A47C 7/74

[52] U.S. Cl. ..... 416/169 A; 416/229 R; 416/234

[58] Field of Search ..... 416/169 A, 223 R, 416/229 R, 179, 180, 182, 183, 234, 235, 236 R, 237, 203, 202, 189, 193 R, 241 A

[56] References Cited

U.S. PATENT DOCUMENTS

| | | | |
|---|---|---|---|
| 329,052 | 10/1885 | Kittoe | 416/179 |
| 911,540 | 2/1909 | Guilford | 416/189 X |
| 1,036,627 | 8/1912 | Huguenin | 416/186 R |
| 1,512,273 | 10/1924 | Gallahan | 416/237 |
| 1,827,225 | 10/1931 | Ferreby | 416/235 |
| 2,137,559 | 11/1938 | Algee | 416/189 |
| 3,642,382 | 2/1972 | Hayashi | 416/169 R |
| 3,659,471 | 5/1972 | Marsch | 416/229 R X |
| 3,727,593 | 4/1973 | Enke | 416/169 A X |
| 3,751,181 | 8/1973 | Hayashi | 416/229 R X |
| 4,762,465 | 8/1988 | Friedrichs | 416/241 A X |
| 5,193,981 | 3/1993 | Scheidel et al. | 416/179 |
| 5,399,070 | 3/1995 | Alizaden | 416/189 |
| 5,419,682 | 5/1995 | Martin | 416/229 R X |

FOREIGN PATENT DOCUMENTS

| | | | |
|---|---|---|---|
| 172632 | 3/1904 | Germany . | |
| 02890 | 12/1970 | Germany . | |
| 2 055 404 | 5/1972 | Germany . | |
| 24 01 462 | 7/1975 | Germany . | |
| 29 02 135 | 7/1979 | Germany . | |
| 82 07 203 | 8/1982 | Germany . | |
| 33 04 296 | 9/1983 | Germany . | |
| 34 25 502 | 1/1986 | Germany . | |
| 183 596 | 6/1986 | Germany . | |
| 40 20 742 | 6/1990 | Germany . | |
| 41 17 342 | 5/1991 | Germany . | |
| 54-157309 | 12/1979 | Japan | 416/182 |
| 1-294999 | 11/1989 | Japan | 416/182 |

OTHER PUBLICATIONS

Von Kurt Hauser, Dusen–Mantellufter fur Nutzfahrzeug–Kuhlanlagen, (1992), pp. 542–547.

Patent Abstract of Germany, Eiichi Moriyama, Engine Cooling Fan, (1978), p. 78.

*Primary Examiner*—John E. Ryznic
*Attorney, Agent, or Firm*—Foley & Lardner

[57] ABSTRACT

An axial-flow fan comprises a hub having an axial dimension $T_N$, and including a planar portion extending in a radial direction. Axial blades connected to the hub, and each axial blade has an axial dimension $T_{Sch}$ in a vicinity of a radially outermost portion of the hub. The axial dimension $T_{Sch}$ of each axial blade is greater than the axial dimension $T_N$ of the hub. Each axial blade has a projection Ü beyond the planar portion of the hub. The projection Ü extends axially from a leading edge of each axial blade to the planar portion of the hub.

21 Claims, 9 Drawing Sheets

Fig. 7
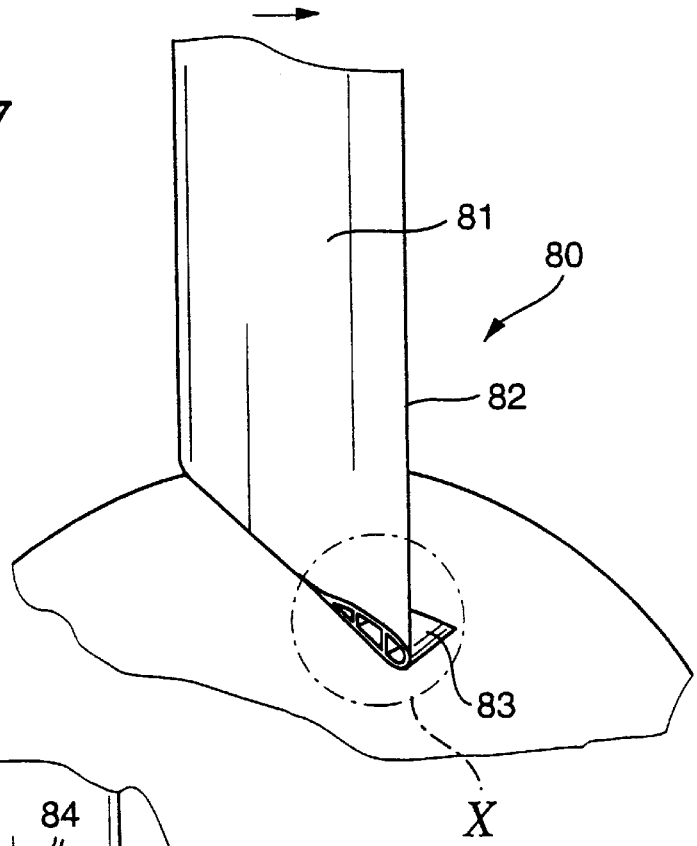
"X"
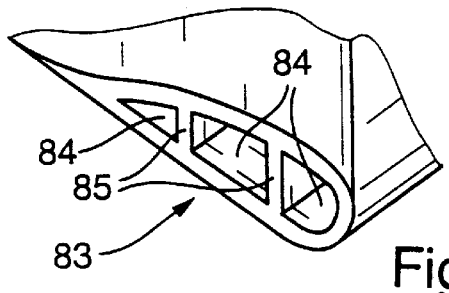
Fig. 7a
Fig. 8
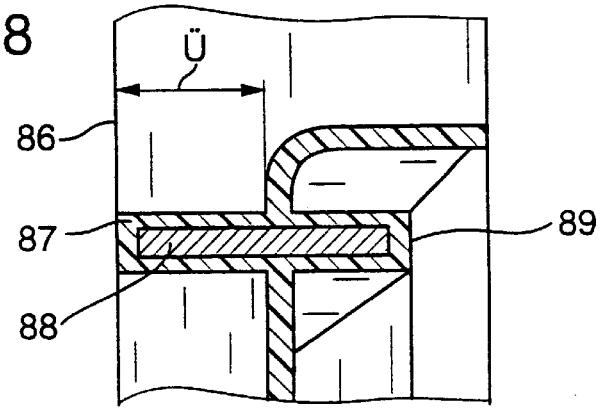

AXIAL-FLOW FAN FOR THE RADIATOR OF AN INTERNAL COMBUSTION ENGINE

FIELD OF THE INVENTION

This invention relates to an axial-flow fan for the radiator of an internal combustion engine of a motor vehicle, and more particularly to an axial-flow fan having axial blades fastened to a hub.

BACKGROUND OF THE INVENTION

Axial-flow fans of this type are known from DE-A 33 04 296. For the purpose of improving the semi-axial flow in this type of fan, an "annular disk" was attached to the downstream region of the cylindrical hub and resulted in flow stabilization by virtue of an annular vortex being formed. In addition to this annular disk, a front ring was provided, as a flow-directing surface, in the region of the fluid-friction clutch. The front ring deflected the radial clutch flow in the direction of the annular disk. The disadvantage with this known design was that the flow of this fan, in particular in the hub regions, was not satisfactory for all operating states.

The problems of an axial-flow fan for radiators of motor vehicles are described in detail in Behr's company publication "Düsen-Mantellüfter für Nutzfahrzeug-Kühlanlagen" (Injector-bushing fan for cooling systems of commercial vehicles), by Kurt Hauser, published in MTZ Motortechnische Zeitsschrift, 53rd year, issue 11/92. Point 3 of the publication discusses the throttle coefficient and the different operating ranges of the axial-flow fan. It can be gathered from this description that the axial-flow fan, which is installed in the motor vehicle between the radiator and the internal combustion engine, and is thus subjected to relatively pronounced throttling, has flow passing through it semi-axially in most cases. There is also a superposition of the radially directed flow of the clutch, arranged in the interior of the fan, upon the semi-axial flow. These differing and changing boundary conditions make it difficult to design such a fan.

DE-A 29 02 135 discloses a fan drive for a radiator of an internal combustion engine, wherein an axial-flow fan is driven via a fluid-friction clutch. The axial-flow fan is fastened to the clutch via a hub cross, through which flow takes place in the axial direction. The fan hub is shortened in the axial direction with respect to the blade depth, resulting in the leading blade edge projecting slightly in front of the hub end side. An annular gap is left between the hub and the fluid-friction clutch and, through this annular gap, the fan takes in a secondary airstream in the forward direction from the rear side of the fan in order to cool the rear side of the clutch. This annular gap increases the overall axial depth of the fan and the external diameter of the fan, which is undesirable in present motor vehicles. Furthermore, the efficiency of this fan is impaired by the secondary airstream.

The problems identified above are not intended to be exhaustive but rather are among many which tend to reduce the desirability of previous axial-flow fans. Other problems may also exist. However, those presented above should be sufficient to demonstrate that currently known solutions are amenable to worthwhile improvement.

SUMMARY OF THE INVENTION

One object of the present invention is to provide, for an axial-flow fan, a configuration which solves the aforementioned problems to meet the requirements of such an axial-flow fan, i.e., increased air output, improved efficiency, reduced fan noise, and cost-effective mass production.

The present invention therefore provides an axial-flow fan comprises a hub having an axial dimension $T_N$, and including a planar portion extending in a radial direction. Axial blades connected to the hub, and each axial blade has an axial dimension $T_{Sch}$ in a vicinity of a radially outermost portion of the hub. The axial dimension $T_{Sch}$ of each axial blade is greater than the axial dimension $T_N$ of the hub. Each axial blade has a projection Ü beyond the planar portion of the hub. The projection Ü extends axially from a leading edge of each axial blade to the planar portion of the hub.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIG. 7 shows a partial axial view of a sixth embodiment of the fan of the present invention, illustrating a hollow profile for the web;

FIG. 7*a* shows a detailed view of the hollow web of FIG. 7;

FIG. 8 shows an axial section through a seventh embodiment of a fan of the present invention, including a metallic web reinforcement;

DETAILED DESCRIPTION OF THE PREFERRED EMBODIMENTS

Figure 1:
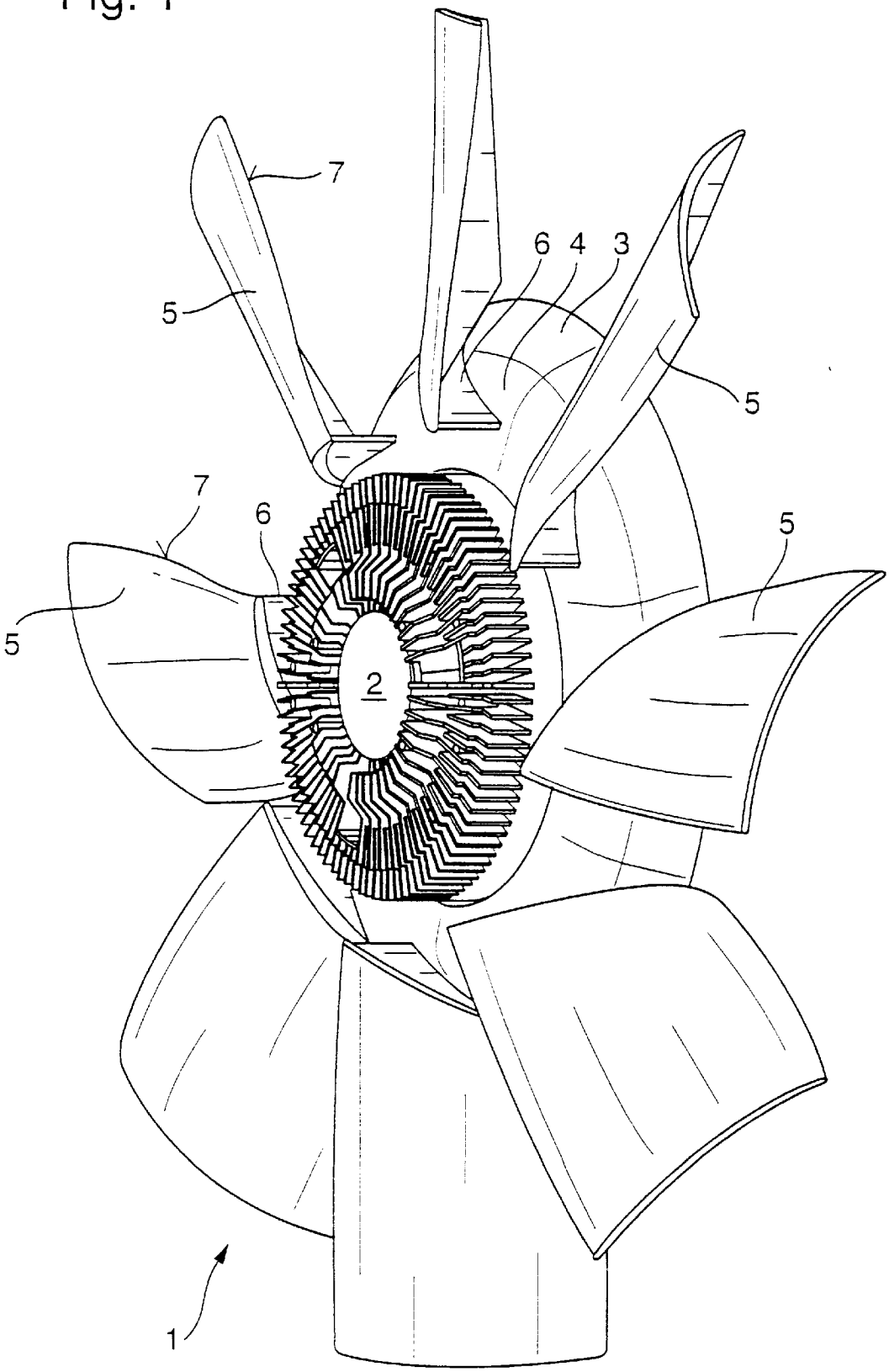
FIG. 1 shows a perspective illustration of the fan according to the invention with a fluid-friction clutch.

FIG. 1 shows a perspective view of an axial-flow fan 1 of the present invention, which is fastened on the output-side housing of a fluid-friction clutch 2 and is driven by the clutch. A motor-vehicle internal combustion engine (not illustrated) drives the fan through the clutch. The fan 1 is arranged behind a motor-vehicle radiator (not illustrated), as seen in the direction of air flow, and takes in ambient air through a radiator or other cooling module, which may comprise a plurality of heat exchangers, e.g., a charge-air cooler and condenser of an air conditioning system. The fan 1 has two hub portions 3, 4. Hub portion 3 has a conical surface, and the hub portion 4 has a toroidally curved surface. A plurality of axial blades 5 are fastened on the circumference of the hub portion 3. Each blade 5 has a projection 6 in relation to an outermost surface of the curved hub portion 4. The amount of the projection 6 is the axial distance between leading edges of the blades and the outermost surface of the curved hub portion 4. A more precise illustration and explanation of this blade projection 6 according to the invention will be given in the following figure-related descriptions.

Figure 2:
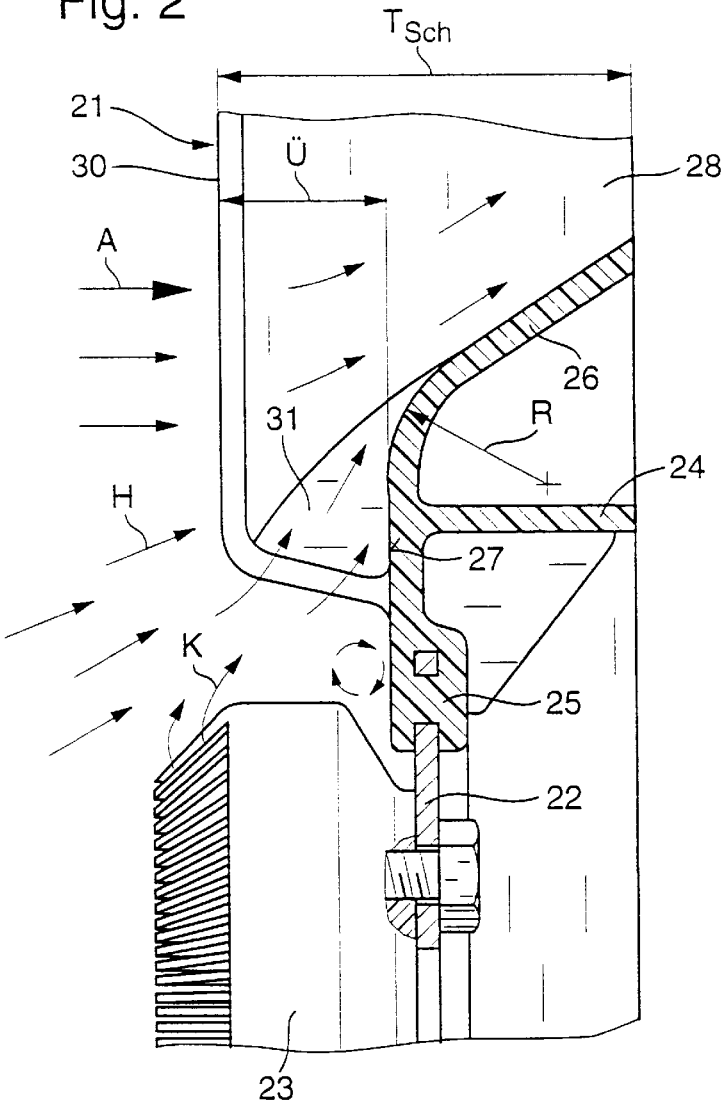
FIG. 2 shows an axial section through a first embodiment of a fan of the present invention, including a conical hub.

FIG. 2 shows an axial section through an inventive axial-flow or semiaxial-flow fan 21, which is connected to a fluid-friction clutch 23 in a rotationally fixed manner by means of a flange ring 22. This fluid-friction clutch 23 is driven in a known manner (not illustrated) via the crankshaft or a belt drive of the internal combustion engine. The fan 21 has a hub 24 which comprises an inner fastening flange 25 and a conical portion 26, for which reason, as a result of its semi-axial flow, this fan is also referred to as a semiaxial-flow fan. Axial blades 28 are fastened on this conical portion 26, which merges into an planar portion 27 through a curvature of radius R. The axial blades 28 have an axial extent dimension (or blade width) $T_{Sch}$, which is measured from the rear edge 29 of a blade to a leading edge 30 of the blade, in the axial direction. According to the invention, the blade 28 has a projection Ü in relation to the planar portion 27, i.e., the leading edge 30 is offset by the dimension Ü with respect to the planar portion 27, counter to the direction of oncoming flow A. As can be seen from FIG. 2*a*, which is a partial view in the radial direction, the region between the leading edge 30 and the planar portion 27 is in the form of an interstice in FIG. 2*a,* and is filled by a web 31. This web 31 serves primarily to support the portion of the blade which projects Ü beyond the planar portion 27, in order to achieve sufficient strength for the attachment of the blade 28 to the hub 24. As is known, at higher rotational speeds of the fan there are centrifugal forces in the blade which would result in corresponding bending moments in the case of a protruding blade. This pronounced loading is absorbed by the web 31. The entire fan, including hub 24, blades 28 and web 31, is injection molded as a single-piece plastic part.

Figure 2B:
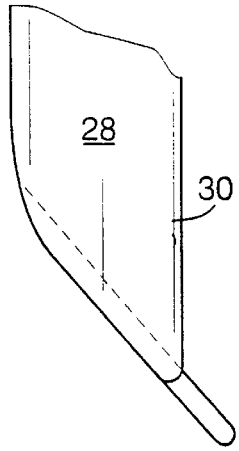
FIG. 2*b* shows a partial view of the embodiment of FIG. 2 in an axial direction.
Figure 2A:
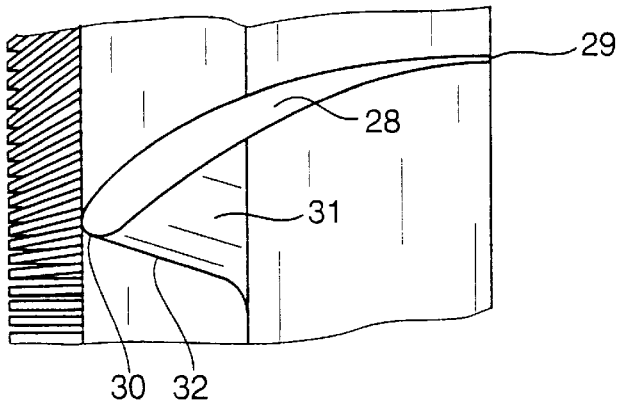
FIG. 2*a* shows a partial view of the embodiment of FIG. 2 in a radial direction.

FIG. 2*b* shows a partial view in the direction of air flow A on the blade 28 with the leading edge 30.

The aerodynamic effect of a blade projection according to the invention, in conjunction with the web 31, is illustrated by the flow arrows in front of the leading edge and in the blade region. In the top region of the leading edge 30, the air flow emerging from a radiator (not illustrated) is represented by the horizontal and parallel flow arrows A. In the radially inner region, this parallel flow A is disrupted by the radial clutch flow K emerging from the clutch as a result of the cooling ribs of the radial clutch. The blade projection results in a more pronounced suction action, which causes deflection of the radially directed clutch flow into a semi-axial flow H, and thus provides smooth inflow conditions. The semi-axial main flow H comes into contact with the leading edge 32 of the web 31 and with the inside of the leading edge 30, and from there flows in the direction of the conical portion 26. The radial clutch flow K is thus intercepted by the main flow H in conjunction with the blade projection and is guided without separation over the entire depth of the conical portion 26. This results in flow around the clutch, which provides effective cooling and smooth flow of air through the fan, resulting in increased efficiency and reduced noise for the fan.

Figure 3:
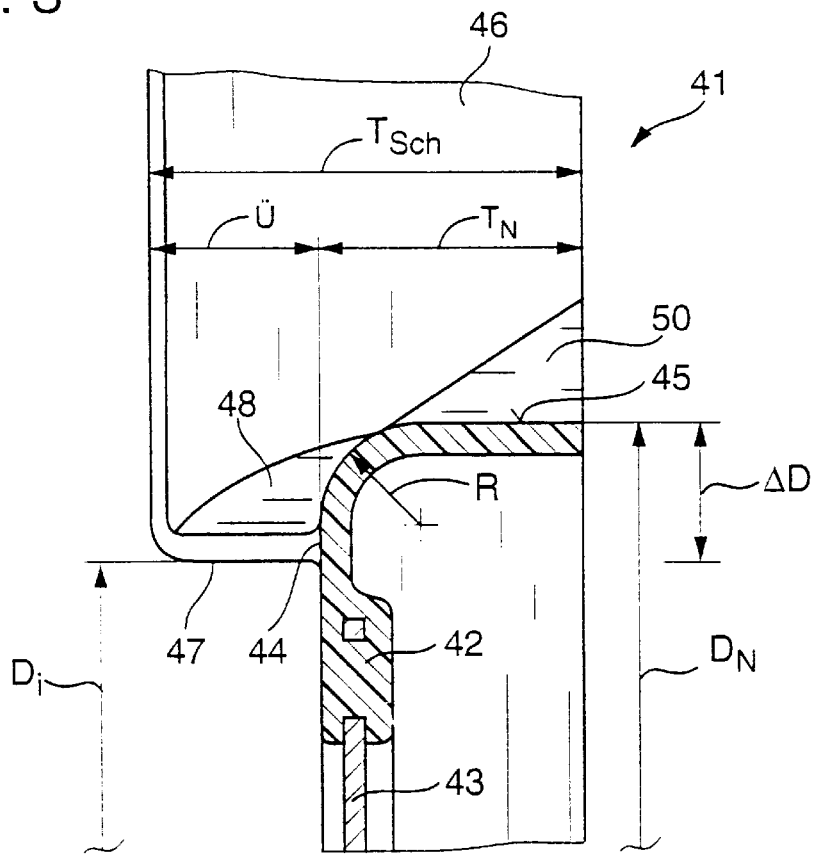
FIG. 3 shows an axial section through a second embodiment of a fan of the present invention, including a cylindrical hub.
Figure 3A:
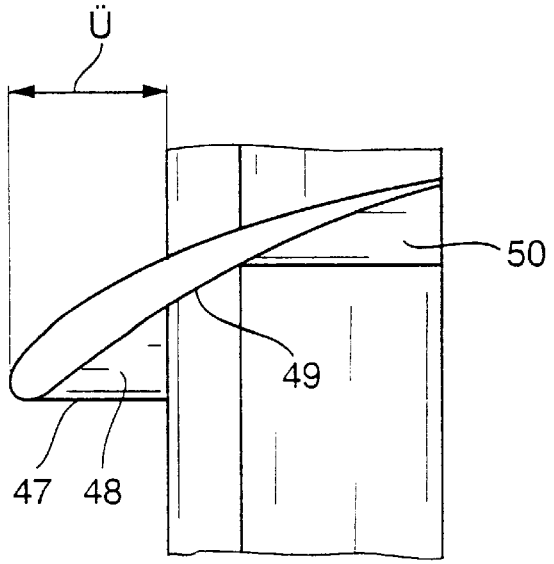
FIG. 3*a* shows a partial view of the embodiment of FIG. 3 in a radial direction.

FIG. 3 illustrates a further embodiment of the hub configuration in an axial-flow fan 41. The fan 41 has a hub 42 which is connected to a metal flange 43 by injection molding. The hub 42 includes a planar portion 44 which merges into a cylindrical portion 45 through a curvature of radius R. Axial blades 46 are integrally molded on these hub portions 44, 45. In the hub region, also known as the blade-root region, each blade has an axial extent of dimension (or blade width) $T_{Sch}$ and projects beyond the planar portion 44 by the dimension Ü. This blade projection is preferably 15% to 60% of the axial extent dimension $T_{Sch}$. Furthermore, in the region of the projection Ü, the inner diameter $D_i$ of the blade 46 is less than an inner diameter $D_N$ of the cylindrical hub portion 45. This results in a difference of ΔD between the diameter $D_N$ of the cylindrical hub portion 45 and the inner diameter $D_i$ of the blade 46 (taken from the leading edge 47 of the web 48). This difference ΔD is preferably approximately 5% to 20% of the hub diameter $D_N$. It is known that a cylindrical hub (e.g., such as illustrated in FIG. 3) is disadvantageous for semi-axial flow because there is a risk of flow separation with corresponding vortex formation. Consequently, in a vicinity of the cylindrical hub portion 45, a ramp 50 is provided on the pressure side 49 of the blade 46, as is known from Patent Application DE-A 41 17 342.

Figure 4:
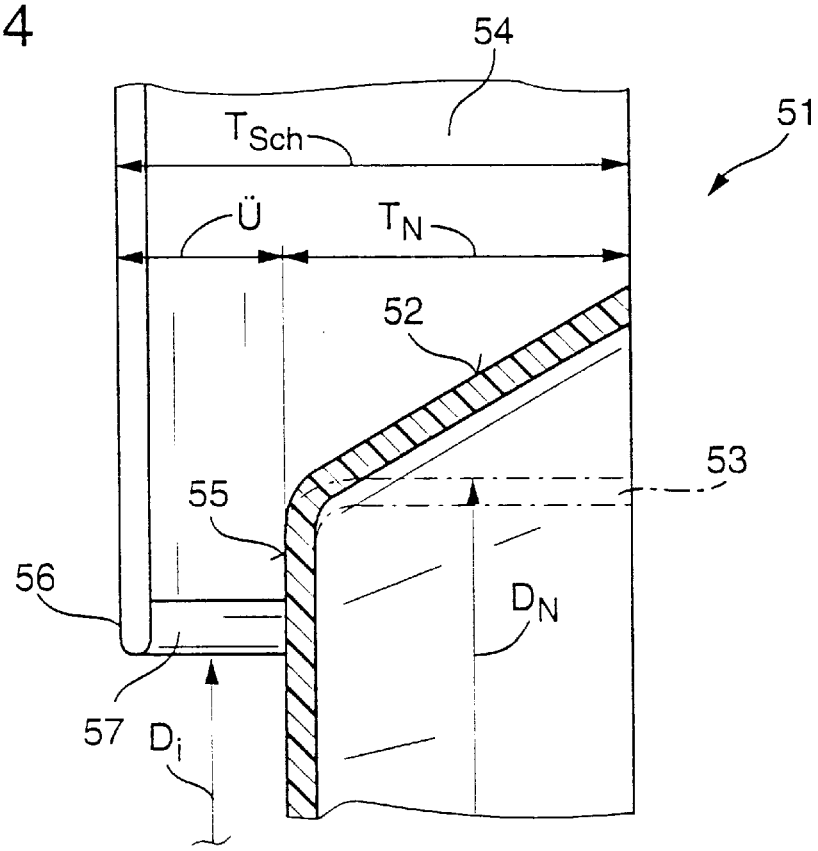
FIG. 4 shows an axial section through a third embodiment of a fan of the present invention, including individual connecting webs between blade projections and a hub end side.
Figure 4A:
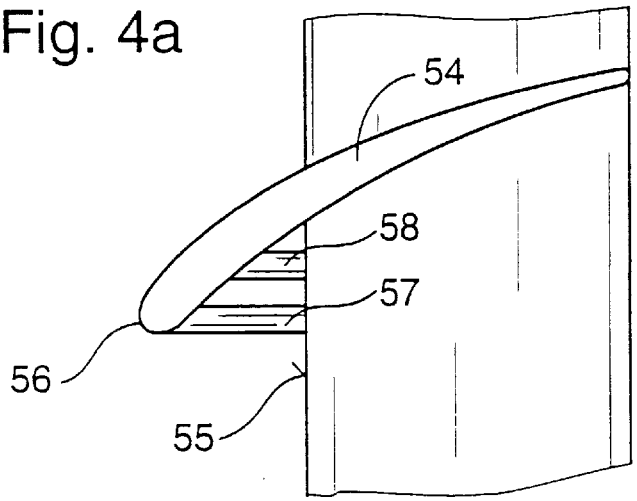
FIG. 4*a* shows a partial view of the embodiment of FIG. 4 in a radial direction.

FIG. 4 shows a further embodiment of an axial-flow fan 51 with a conical hub 52 (which may alternatively have a cylindrical hub 53 illustrated by dashed lines) of hub diameter $D_N$. The axial blade 54 has an axial extent dimension (or blade width) $T_{Sch}$ and a projection of dimension Ü beyond a planar portion 55 of the hub 52. The internal diameter $D_i$ of the innermost region of the leading edge 56 is less than a diameter $D_N$ of the hub 52. The innermost region of the leading edge 56 is connected to the planar portion 55 and forms the bottom boundary of a connecting web 57, behind which a further connecting web 58 (see FIG. 4*a*) is arranged. The connecting webs 57, 58 support the blade projection Ü and are integrally molded, together with the hub 52 and the blade 54, as a plastic injection molding. The connecting webs 57, 58 are demolded (separated from the mold) in the radial direction.

Figure 5:
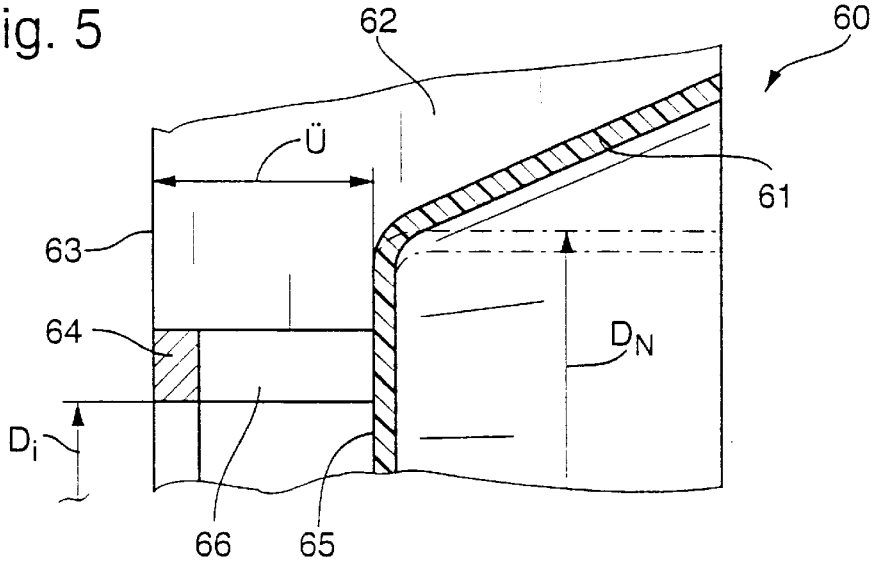
FIG. 5 shows an axial section through a fourth embodiment of a fan of the present invention, including a ring connecting the leading blade edges.
Figure 5A:
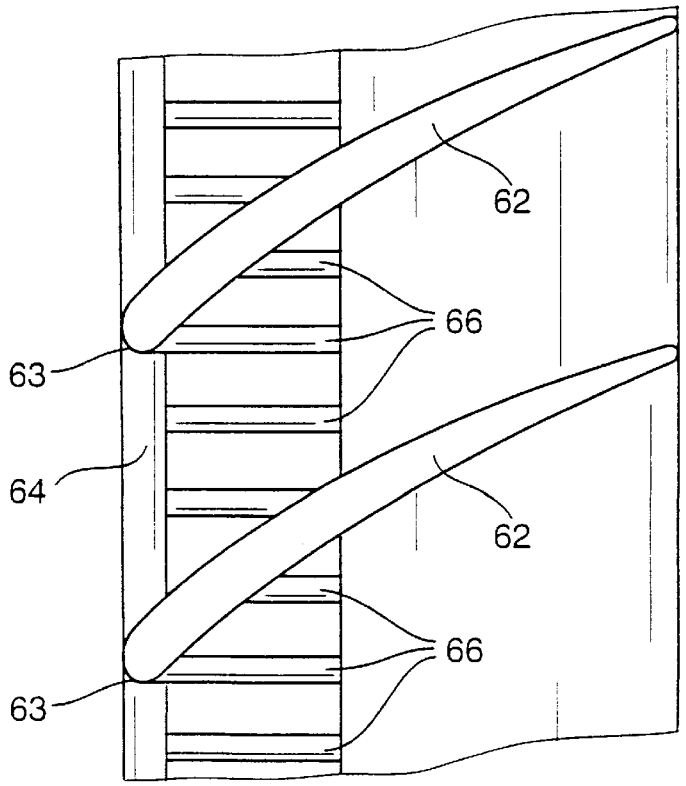
FIG. 5*a* shows a partial view of the embodiment of FIG. 5 in a radial direction.

FIG. 5 shows a further embodiment. A fan 60 with a conical hub 61, (which may alternatively have a cylindrical hub as illustrated by dashed lines). Axial blades 62 are integrally molded on the hub 61. Each blade 62 has a projection Ü beyond a planar portion 65 of the hub 61. The internal diameter $D_i$ of the innermost region of the leading edge 63 is less than a diameter $D_N$ of the hub 61. In the radially inner region of the leading edge 63, i.e., flush with the diameter $D_i$, is a ring 64, shown having a rectangular cross-section which runs all the way around the hub and connects the leading edges 63 to the hub 61 over the entire circumference of the hub (see FIG. 5*a*). The ring may alternatively have other cross-sectional shapes. Arranged between this ring 64 and the planar portion 65, distributed at appropriate intervals over the entire circumference of the ring 64, are axially running connecting webs 66. The connecting webs 66 are configured such that they can be demolded in the radial direction. These connecting webs 66, in conjunction with the ring 64, supporting the blade projection Ü and thus increase the strength of the fan 60.

Figure 6:
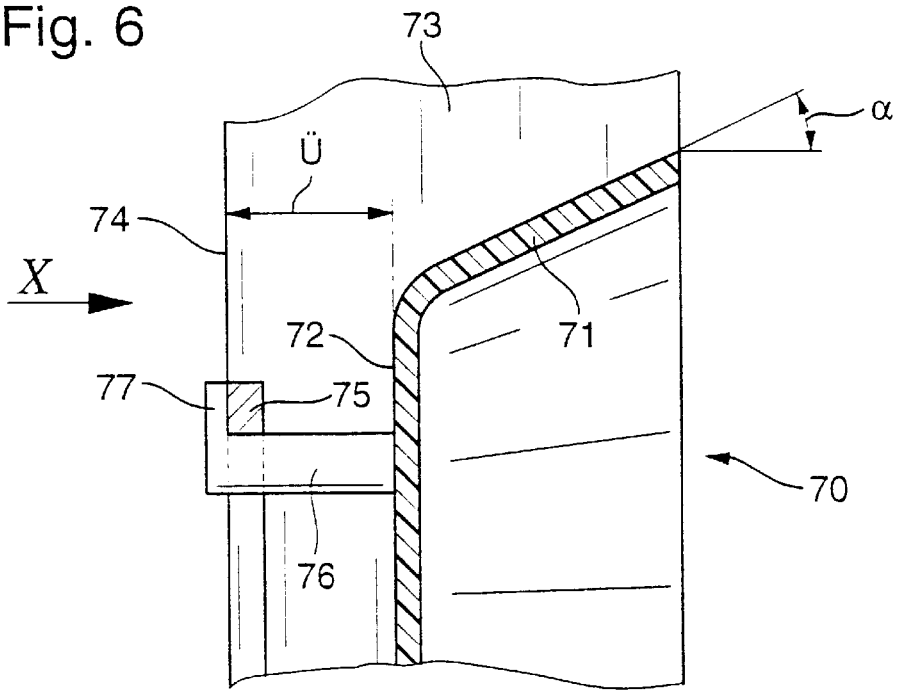
FIG. 6 shows an axial section through a fifth embodiment of a fan of the present invention, including a ring and connecting ribs.
Figure 6A:
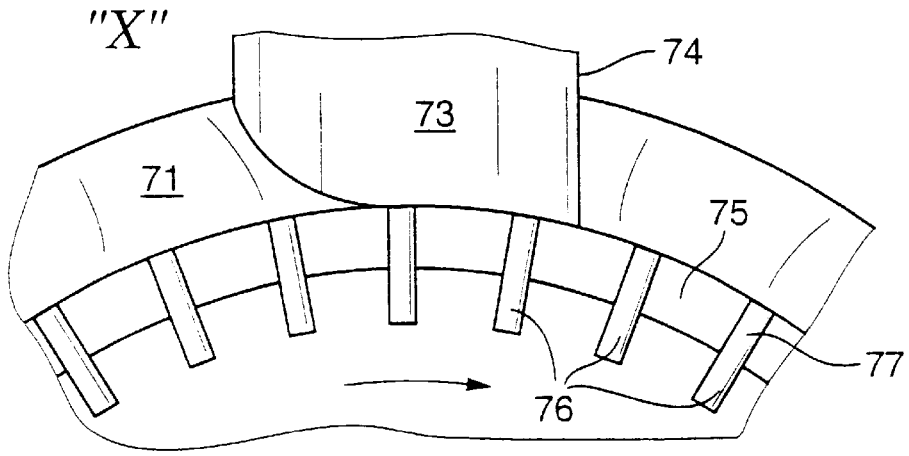
FIG. 6*a* shows a partial view of the embodiment of FIG. 6 in an axial direction.

FIG. 6 shows a further embodiment of an axial-flow fan 70 including a conical hub 71 having an angle of slope of $\alpha \leqq 50°$ with the axial direction. Perpendicular to the axial direction is a leading edge 72 and an axial blade 73 which has a projection Ü beyond the leading edge 72 of the hub 71. In a manner similar to the previously described fan 60, a closed ring 75 is arranged in the innermost region of the leading edges 74. Provided radially between the ring 75 and the hub 71 are plural rib-like connecting webs 76, arranged at intervals over a circumference of the ring. The connecting webs 76 are designed to be open toward a front side of the fan and can therefore be demolded axially toward the front side of the fan. The connecting ribs 76 are aligned radially, i.e., with respect to a center point of the hub, and enclose the ring 75 at a front side thereof with a top portion 77 of the rib and, toward an inside thereof with an axially running portion 76 (see FIG. 6*a*). This enclosure provides a sufficiently strong injection-molded connection between the ribs 76 and the ring 75. The strength of the connection between the ribs 76 and the ring 75 can increase the strength of a fan having a blade projection.

FIG. 7 shows an embodiment for the formation of a web according to the present invention. The web 83 extends between a projection of a blade 81 and planar portion of a respective hub. A portion of a fan 80 is shown, with a blade 81 having a leading edge 82, and the web 83 arranged on a radially inner region of the leading edge. The web has a hollow profile as illustrated in corresponding detailed view 7*a*. The hollow profile 83 is open toward a front side of the hub, and has three chambers 84, separated by vertical webs 85. The hollow profile can increase the strength of the web 83, and provide better support for the blade projection.

In FIG. 8, a leading edge 86 of a blade is supported by a web 87 in which, for reinforcement purposes, provided a metallic insert 88 is provided. The metallic insert 88 is encapsulated on all sides by plastic by injection molding. The web 87, including its metal insert 88, continues to a rear side 89 of the hub.

Figure 9:
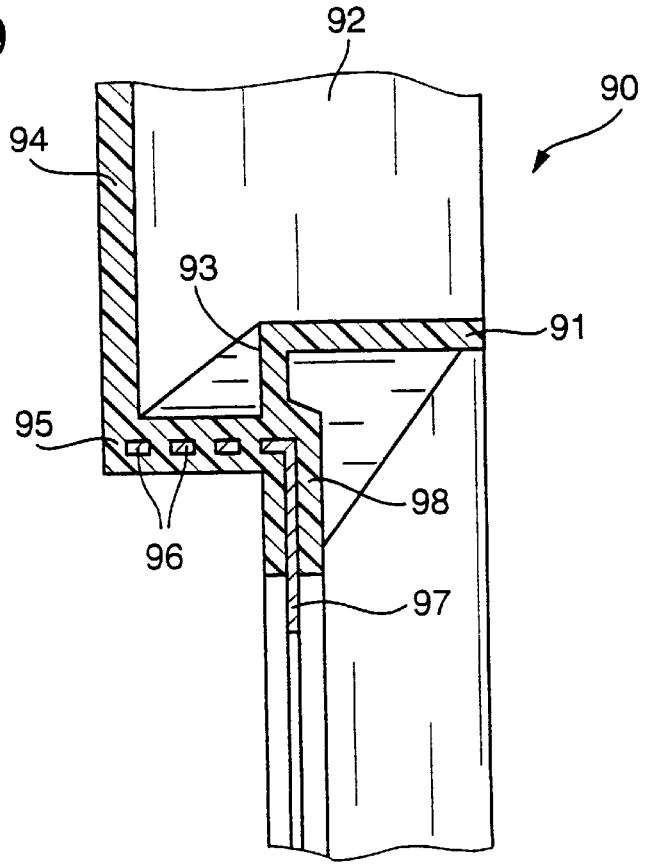
FIG. 9 shows an axial section through an eighth embodiment of a fan of the present invention, including metallic lugs for web reinforcement.
Figure 9A:
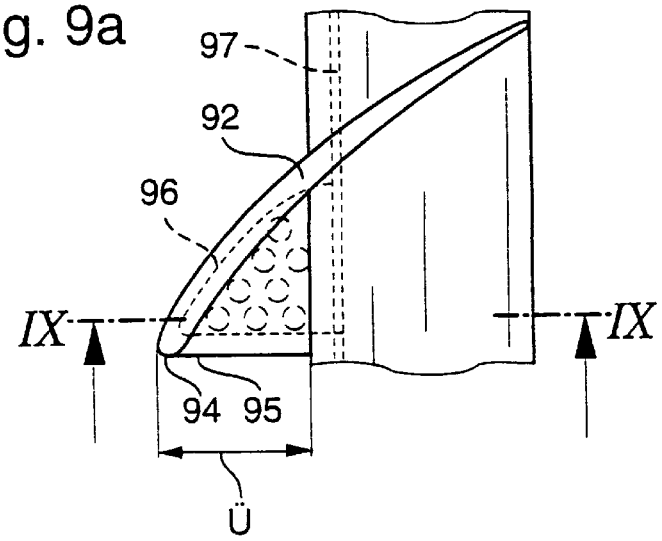
FIG. 9*a* shows a partial view of the embodiment of FIG. 9 in a radial direction.

FIG. 9 shows a further embodiment of a fan 90 having a cylindrical hub 91 and integrally molded blades 92. A leading edge 94 of each blade 92 has a projection Ü in relation to a planar portion 93, i.e., the leading edge 94 is offset by the dimension Ü with respect to the planar portion 93. The web 95 extends radially inward from the leading edge 94 to the hub 91, and includes a metallic reinforcement 96. The metallic reinforcement is preferably formed as a lug (see FIG. 9*a*). The reinforcement 96 preferably has an interstitial form corresponding to a shape of the web 95 between the blade projection Ü and the planar portion 93, and is perpendicular to a planar metal plate 97. Metal plate 97 serves as fastening flange (for fastening to the clutch, as illustrated in FIG. 1). In the vicinity of the web 95 and an inner hub 98, the fastening flange 97 is encapsulated by plastic by injection molding.

Figure 10:
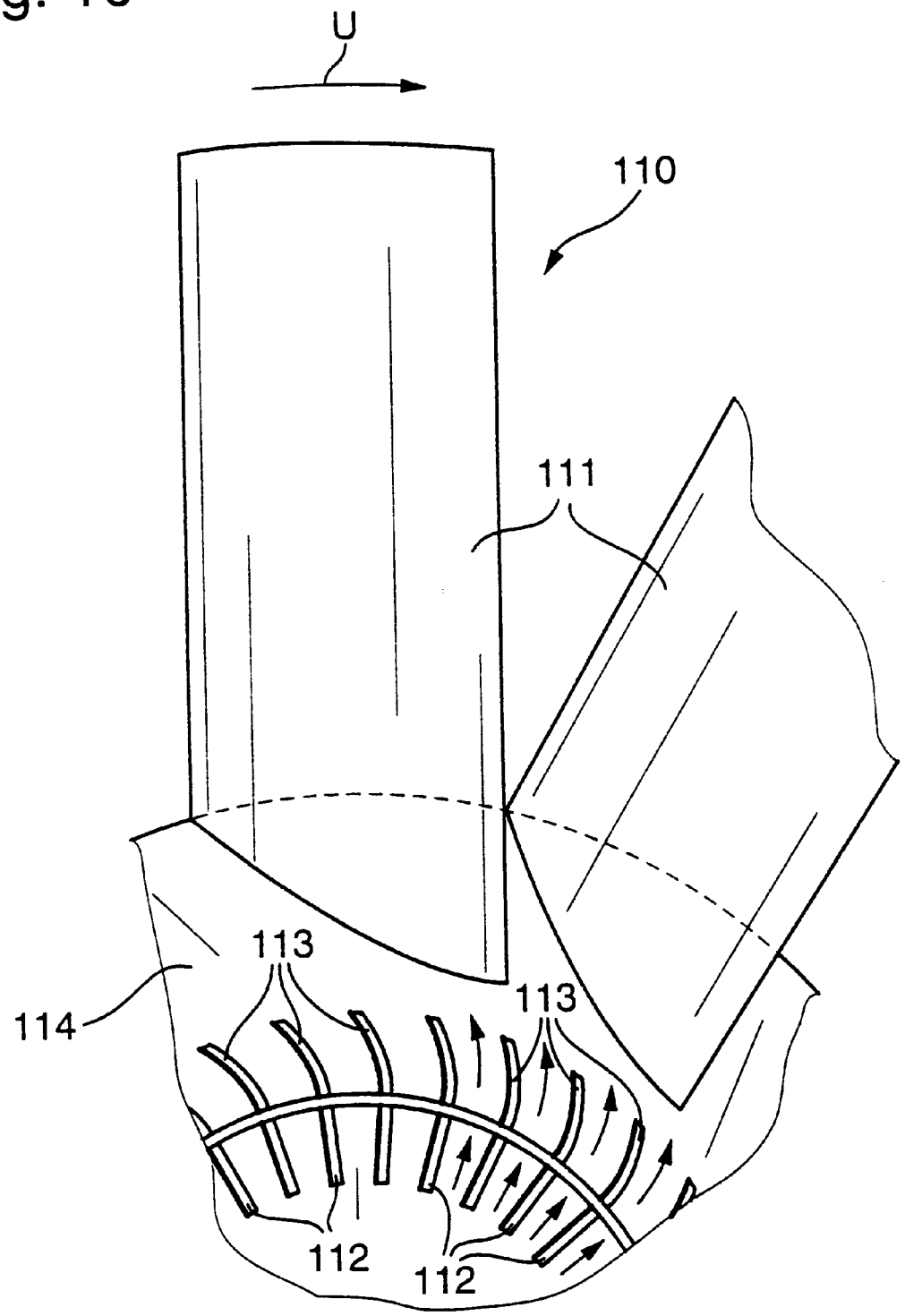
FIG. 10 shows a partial view of a ninth embodiment of a fan of the present invention, including deflecting blades on the hub and on a side.

FIG. 10 shows a partial view in an axial direction of a further embodiment of a fan 110 of the present invention having axial blades 111, with blade projections as described above. As is illustrated in FIG. 1, a clutch is arranged in a radially inner region and has radially running cooling ribs 112 which produce a radially directed air flow (see arrows). Deflecting blades 113 are arranged on a planar portion 114, aligned with and radially outward from the cooling ribs 112 on the clutch. The deflecting blades 113 are curved such that they cause the air flow to be deflected in the circumferential direction—counter to the direction of rotation indicated by arrow U. This arrangement of the deflecting blades 113 achieves improved flow through the fan 110.

The axial blades of the axial-flow fan of the present invention have projections (or, looking at it another way, the fan has a shortened hub). The projecting portion of the blade projects in a direction counter to the direction of air flow and should be between 15% and 60% of the overall dimension of the blade in the axial direction. This measure has a favorable affect on the flow against the blades of the fan, and improves the efficiency of the fan. In particular, the clutch flow, which is directed from a radial inside of the clutch to a radial outside of the clutch, combines with semi-axially directed flow against the fan in a relatively loss-free manner.

In the region of the projection, the blades are drawn inward and connected to a planar portion of the hub, which provides increased strength of the blades. The hub may be designed either cylindrically or conically. A conical hub is more advantageous in flow terms than a cylindrical hub, although a cylindrical hub can be less costly. The flow-related disadvantage of a cylindrical hub can be compensated for by providing a ramp on the hub.

Each blade projection is connected to a respective planar portion of the hub by a web, which further increases the strength of each blade with respect to centrifugal forces acting on the blade. The web, which may be designed as a continuous surface or as individual rib-like webs, ensures secure anchorage and attachment of a foot of the blade to the hub.

Leading edges of the blades can be connected to one another at their radially innermost region by a closed ring which runs all the way round the hub and acts to absorb the centrifugal forces acting on the blades. This ring provides improved support for the blades.

The entire fan is injection molded from plastic, and the plastic webs are reinforced by metal inserts in a preferred embodiment.

German Patent Application No. 197 10 608.0, filed Mar. 14, 1997, is incorporated herein in its entirety.

What is claimed is:

1. An axial-flow fan, comprising:

a hub having an axial dimension $T_N$, and including a planar portion extending in a radial direction; and axial blades connected to the hub, each axial blade having an axial dimension $T_{Sch}$ in a vicinity of a radially outermost portion of the hub, wherein the axial dimension $T_{Sch}$ of each axial blade is greater than the axial dimension $T_N$ of the hub, and each axial blade has a projection Ü beyond the planar portion of the hub, extending axially from a leading edge of each axial blade to the planar portion of the hub, and wherein each axial blade extends radially inward and is connected to the planar portion of the hub.

2. The axial-flow fan as claimed in claim 1, further comprising a fluid-friction clutch arranged radially within the hub, and connected to the hub in a rotationally fixed manner, the clutch including cooling ribs on a front side thereof.

3. The axial-flow fan as claimed in claim 2, further comprising deflecting blades provided on the planar portion, radially within the axial blades.

4. The axial-flow fan as claimed in claim 1, wherein $0.15\ T_{Sch} \leqq Ü \leqq 0.60\ T_{Sch}$, measured in the vicinity of the radially outermost portion of the hub.

5. The axial-flow fan as claimed in claim 1, wherein an inner diameter $D_i$ of an innermost portion of each axial blade is less than a diameter $D_N$ of the outermost portion of the hub such that $0.5\ (D_N - D_i) = 0.05\ D_N$ to $0.2\ D_N$.

6. The axial-flow fan as claimed in claim 1, wherein the hub has a substantially cylindrical shape.

7. The axial-flow fan as claimed in claim 1, wherein the hub has a substantially conical shape.

8. The axial-flow fan as claimed in claim 7, wherein a diameter of the hub increases in a direction of axial air flow, and has a slope of $\alpha \leqq 50°$.

9. The axial-flow fan as claimed in claim 1, further comprising a ring, and wherein the leading edges of the axial blades are connected to one another by the ring.

10. The axial-flow fan as claimed in claim 1, wherein the fan is injection molded as a single-piece plastic part.

11. The axial-flow fan as claimed in claim 10, wherein the web is reinforced by a metallic insert which is encapsulated in plastic by injection molding.

12. The axial-flow fan as claimed in claim 1, wherein the hub includes a cylindrical portion which merges into the planar portion of the hub through a radius R, and $R \geqq 0.03\ D_N$.

13. An axial-flow fan, comprising:

a hub having an axial dimension $T_N$, and including a planar portion extending in a radial direction; and axial blades connected to the hub, each axial blade having an axial dimension $T_{Sch}$ in a vicinity of a radially outermost portion of the hub, wherein the axial dimension $T_{Sch}$ of each axial blade is greater than the axial dimension $T_N$ of the hub, and each axial blade has a projection Ü beyond the planar portion of the hub, extending axially from a leading edge of each axial blade to the planar portion of the hub, and wherein the projection Ü of each axial blade is connected to the planar portion of the hub by a web.

14. The axial-flow fan as claimed in claim 13, wherein the web is a continuous surface extending between the planar portion and each projection Ü in a direction of axial air flow.

15. The axial-flow fan as claimed in claim 13, wherein the web includes plural spaced-apart ribs extending between the planar portion and each projection Ü in a direction of axial air flow.

16. The axial-flow fan as claimed in claim 13, wherein the web has a hollow profile and extends between the planar portion and each projection Ü in a direction of axial air flow.

17. The axial-flow fan as claimed in claim 16, wherein the web can be demolded axially.

18. The axial-flow fan as claimed in claim 16, wherein the hollow profile of the web opens toward a front side of the fan.

19. An axial-flow fan, comprising:

a hub having an axial dimension $T_N$, and including a planar portion extending in a radial direction; and axial blades connected to the hub, each axial blade having an axial dimension $T_{Sch}$ in a vicinity of a radially outermost portion of the hub, wherein the axial dimension $T_{Sch}$ of each axial blade is greater than the axial dimension $T_N$ of the hub, and each axial blade has a projection Ü beyond the planar portion of the hub, extending axially from a leading edge of each axial blade to the planar portion of the hub, said axial-flow fan further comprising a ring, and wherein the leading edges of the axial blades are connected to one another by the ring, and wherein ribs are provided between the ring and the planar portion of the hub, and are spaced at intervals over an entire circumference of the ring.

20. An axial-flow fan, comprising:

a hub having an axial dimension $T_N$, and including a planar portion extending in a radial direction; and axial blades connected to the hub, each axial blade having an axial dimension $T_{Sch}$ in a vicinity of a radially outermost portion of the hub, wherein the axial dimension $T_{Sch}$ of each axial blade is greater than the axial dimension $T_N$ of the hub, and each axial blade has a projection Ü beyond the planar portion of the hub, extending axially from a leading edge of each axial blade to the planar portion of the hub, and wherein a ramp is provided on the hub, in a pressure-side region of each blade.

21. An axial-flow fan, comprising:

a hub having an axial dimension $T_N$, and including a planar portion extending in a radial direction; and axial blades connected to the hub, each axial blade having an axial dimension $T_{Sch}$ in a vicinity of a radially outermost portion of the hub, wherein the axial dimension $T_{Sch}$ of each axial blade is greater than the axial dimension $T_N$ of the hub, and each axial blade has a projection Ü beyond the planar portion of the hub, extending axially from a leading edge of each axial blade to the planar portion of the hub, wherein the fan is injection molded as a single-piece plastic part, wherein the web is reinforced by a metallic insert which is encapsulated in plastic by injection molding, and said axial-flow fan further comprising a metallic fastening flange, and wherein the metallic insert is a lug connected to the metallic fastening flange.

* * * * *